US006202617B1

(12) United States Patent
Takahashi

(10) Patent No.: US 6,202,617 B1
(45) Date of Patent: Mar. 20, 2001

(54) CYLINDER HEAD OF A DOHC TYPE ENGINE

(75) Inventor: Katsunori Takahashi, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/395,153

(22) Filed: Sep. 14, 1999

(30) Foreign Application Priority Data

Sep. 14, 1998 (JP) ..... 10-279424

(51) Int. Cl.[7] ..... F02F 1/40
(52) U.S. Cl. ..... 123/193.5
(58) Field of Search ..... 123/193.5, 193.3, 123/193.1, 90.27

(56) References Cited

U.S. PATENT DOCUMENTS 4,709,667 * 12/1987 Ichihara et al. ..... 123/90.27
4,754,729 * 7/1988 Abe et al. ..... 123/193.5
4,757,789 * 7/1988 Laine ..... 123/193.5
4,879,980 * 11/1989 Piazzo ..... 123/193.5
5,003,958 * 4/1991 Yoneyama et al. ..... 123/193.5
5,080,057 * 1/1992 Batzill et al. ..... 123/90.27
5,535,714 * 7/1996 Aoyama et al. ..... 123/193.5
5,875,754 * 3/1999 Ickinger ..... 123/193.5
5,957,104 * 9/1999 Ohsawa ..... 123/193.5

FOREIGN PATENT DOCUMENTS

2584601 B2 11/1996 (JP) .

* cited by examiner

*Primary Examiner*—M. McMahon
(74) *Attorney, Agent, or Firm*—Birch, Stewart, Kolasch & Birch, LLP

(57) ABSTRACT

A cylinder head includes a cam holder mating surface and a cylinder mating surface. The cam holder mating surface is non-parallel with respect to the cylinder mating surface. Ignition plug holes are formed in the cylinder head and a cam holder. The plug holes are aligned and have a common extension axis which is perpendicular to the cylinder mating surface and non-perpendicular to the cam holder mating surface. A bolt attaches the cam holder to the cylinder head and extends in a direction which parallels the extension axis of the plug holes, is perpendicular to the cylinder mating surface, and non-perpendicular to the cam holder mating surface.

16 Claims, 3 Drawing Sheets

CYLINDER HEAD OF A DOHC TYPE ENGINE

BACKGROUND OF THE INVENTION

1. Field of the Invention

The present invention relates to a cylinder head of a DOHC (Double Overhead Camshaft) type engine.

2. Description of the Background Art

A cylinder head of a DOHC engine is described in Japanese Patent No. 2584601. The cylinder head includes a tightening bolt for a cam holder, which is tightened in a direction at right angles to a mating surface of the cylinder head and the cam holder.

Providing a cylinder head with such a structure is unfavorable to maintenance performance because the tightening bolt overhangs an extension line of the plug hole. This is also unfavorable to making the space between the air intake and exhaust camshafts narrower and the cylinder head more compact. Moreover, this problem will be further exasperated if such a structure is adopted that the mating surface of the cam holder and the cylinder head is inclined with respect to the mating surface of the cylinder head and the cylinder.

FIG. 3 shows another structure in accordance with the background art. In FIG. 3, a cam holder mating surface c between a cylinder head a and a cam holder b is inclined with respect to a cylinder head mating surface d between the cylinder head a and the cylinder (not shown in FIG. 3). A head gasket e is located adjacent the cylinder head mating surface d.

A lower plug hole f is provided in the cylinder head a at a right angle to the cylinder head mating surface d. An ignition plug g is located inside the lower plug hole f. An electrode section of the ignition plug g reaches to a combustion chamber h.

An upper plug hole k communicates with the lower plug hole f. The upper plug hole k is provided in the cam holder b. The upper plug hole k is formed at a right angle to the cam holder mating surface c, so that the upper plug hole f is bent relative to the lower plug hole f.

An air intake side camshaft m and an exhaust side camshaft n are arranged on the cam holder mating surface c. The air intake side camshaft m and an exhaust side camshaft n are located on either side of the lower plug hole f and the ignition plug g. The air intake side camshaft m and an exhaust side camshaft n are held by cam holder tightening bolts p, fixing the cam holder b on the cylinder head a. The cam holder tightening bolts p are provided at right angles to the cam holder mating surface c.

Such a structure makes it difficult to make the cylinder head compact because the external shape of the cam holder b projects toward the inclined direction by the size of the head section of the bolt p. In addition, a part of the cam holder b surrounding the upper plug hole k overhangs an extension line of the lower plug hole f and enters the extension line of the lower plug hole f by a dimension D. This arrangement makes it difficult to install and remove the ignition plug g. Further, the overhang sets a limit on making the air intake side camshaft m and exhaust side camshaft n closer.

SUMMARY OF THE INVENTION

It is an object of the present invention to solve one or more of the drawbacks associated with the background art.

It is a further object of the present invention to provide a cylinder head and cam holder which are compact is size.

It is a further object of the present invention to provide a cylinder head and cam holder which allow a pinch angle between an air intake camshaft and an exhaust camshaft to be small.

It is a further object of the present invention to provide a cylinder head and cam holder which make maintenance operations on an ignition plug easier.

These and other objects are accomplished by providing a cylinder head for an internal combustion engine comprising: a cylinder head body; a cam holder mating surface formed on one side of said cylinder head body; a cylinder mating surface formed on another side of said cylinder head body; and at least one threaded bolt hole formed in said cam holder mating surface and extending into said cylinder head body perpendicular to said cylinder mating surface.

Further, these and other objects are accomplished by providing a cylinder head for an internal combustion engine comprising: a cylinder head body; a cam holder mating surface formed on one side of said cylinder head body; a cylinder mating surface formed on another side of said cylinder head body; an ignition plug hole formed in said cylinder head body and having an axis of extension; and at least one threaded bolt hole formed in said cam holder mating surface and extending into said cylinder head body parallel to said axis of extension.

Moreover, these and other objects are accomplished by providing an internal combustion engine comprising: a cylinder head body; a cam holder body abutting said cylinder head body at a cam holder mating surface formed on one side of said cylinder head body; a cylinder mating surface formed on another side of said cylinder head body; a first threaded bolt hole formed in said cylinder head body; a second threaded bolt hole formed in said cam holder and aligned with said first threaded bolt hole, wherein said first and second threaded bolts holes extend in a direction at a right angle relative to said cylinder mating surface; and a bolt engaged within said first and second threaded bolt holes to attach said cam holder to said cylinder body.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
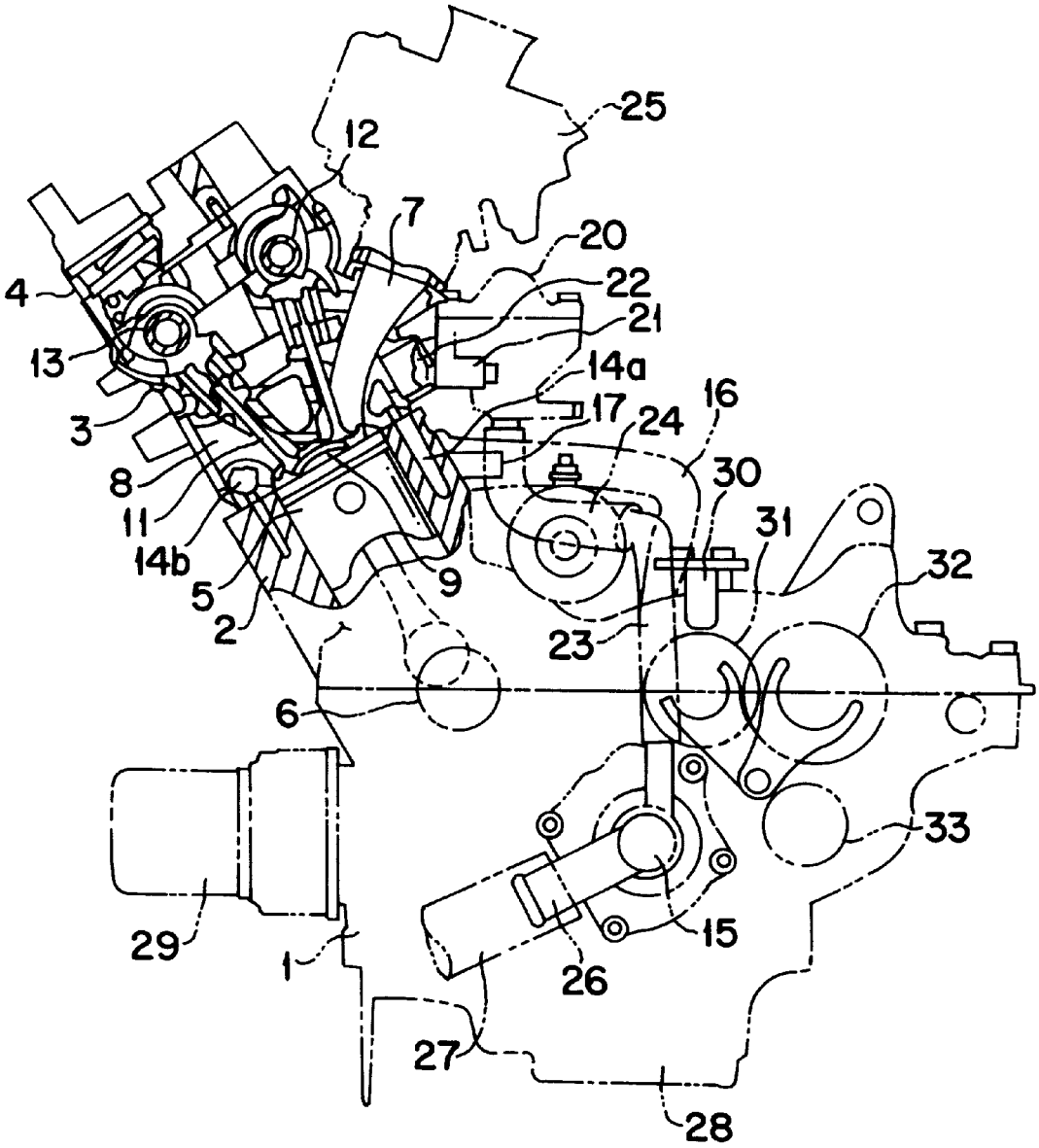
FIG. 1 is a partial cross sectional view of an engine including a cylinder head and a cam holder, in accordance with the present invention.

FIG. 1 illustrates a DOHC type water-cooled four-cycle engine for a motorcycle. The engine includes a crankcase 1, a cylinder 2, a cylinder head 3, and a cylinder head cover 4. A piston 5 is contained in the cylinder 2 and is capable of freely sliding therein. The piston 5 is connected to a crankshaft 6 (the center of which is shown in FIG. 1) in the crank case 1. A combustion chamber 9 is formed between the piston 5, the cylinder 2, and the cylinder head 3.

An air intake port 7 and an exhaust port 8 are provided at the cylinder head 3. The air intake port 7 and the exhaust port 8 lead to the combustion chamber 9. The air intake port 7 and the exhaust port 8 are opened or closed by an air intake valve 10 and an exhaust valve 11, respectively. The air intake valve 10 and exhaust valve 11 are driven by respective cams on an air intake camshaft 12 and an exhaust camshaft 13 synchronously rotating with the crankshaft 6.

The engine includes a water jacket 14*a*, 14*b*, a water pump 15, a water hose 16, a thermostat 20, a cooling water outlet section 22, and a bypass hose 23. The engine also includes a starter motor 24, a carburetor 25, a suction pipe 26 through which cooling water from a radiator is supplied via a water hose 27. The engine also includes an oil pan 28, an oil filter 29, a speed sensor 30 for a transmission that is provided on a main shaft 31 of the transmission, a counter shaft 32, and a shift drum 33.

Figure 2:
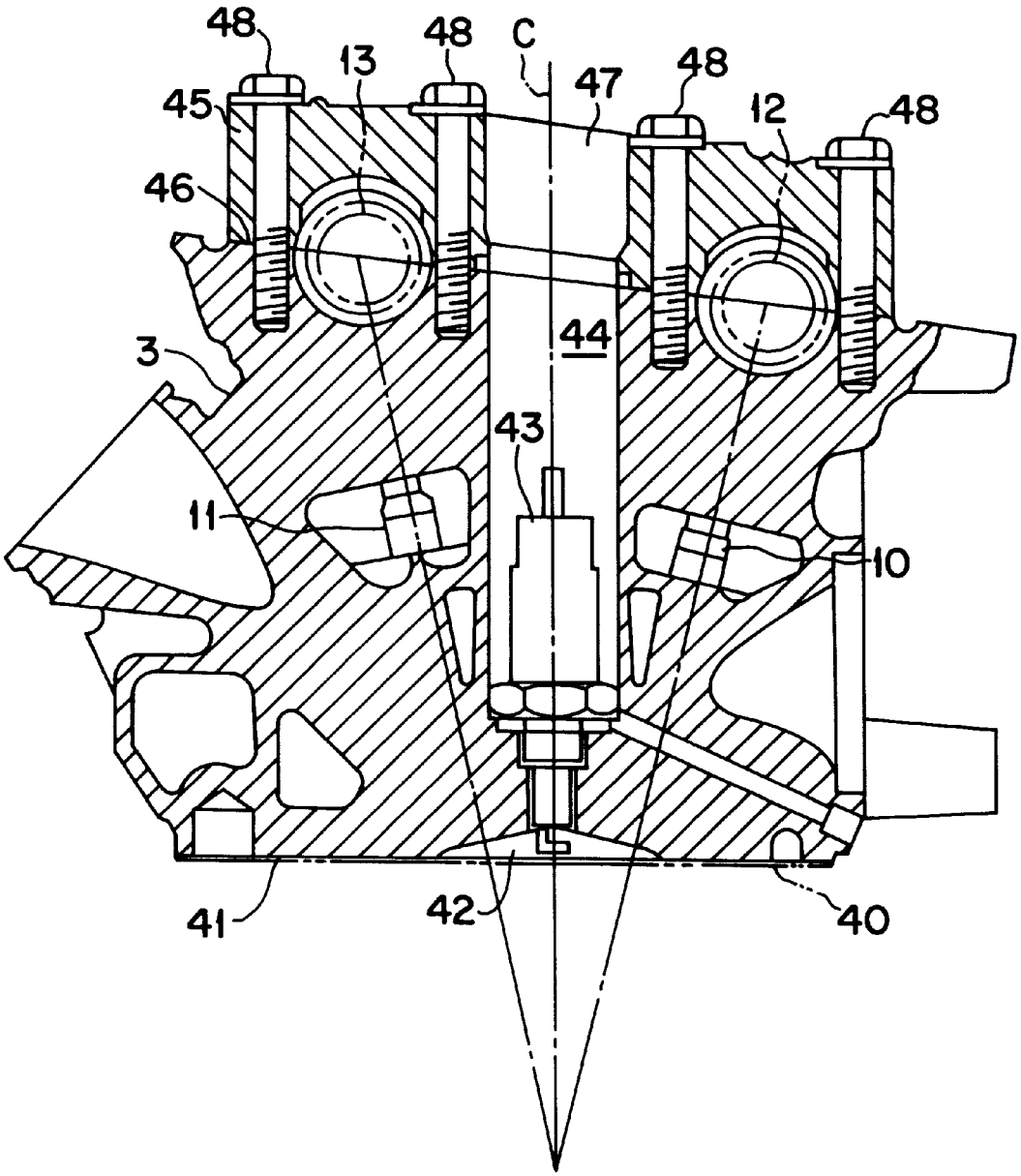
FIG. 2 is a cross sectional view of the cylinder head and the cam holder of FIG. 1.

Now, with reference to FIG. 2, a cylinder head 3 of the engine will be described. The cylinder side end surface of the cylinder head 3 forms a cylinder side mating surface 41 that joins with the cylinder 2. A ceiling section for the combustion chamber 42 is provided at the cylinder side mating surface 41.

A lower plug hole 44 is provided in the cylinder head 3 to access an ignition plug 43. An electrode section of the ignition plug 43 faces to the combustion chamber 42. It should be noted that the lower plug hole 44 is formed at a right angle with respect to the cylinder side mating surface 41.

A side end surface of the cylinder head 3, opposite the cylinder side mating surface 41, includes a cam holder side mating surface 46. A cam holder 45 is attached to the cam holder side mating surface 46. This cam holder side mating surface 46 is inclined with respect to the cylinder side mating surface 41.

An upper plug hole 47 is provided in the cam holder 45 to access the ignition plug 43. The upper plug hole 47 is formed as an extension of the lower plug hole 44. An axis of the upper plug hole 47 is at a right angle with respect to the cylinder side mating surface 41 of the cylinder head 3, so as to be inclined with respect to the cam holder side mating surface 46. The axes of the lower plug hole 44 and the upper plug hole 47 are common and form a straight axis C. The axis C is also a center axis of the ignition plug 43.

The air intake camshaft 12 and the exhaust camshaft 13 are arranged on the cam holder side mating surface 46, on either side of the lower plug hole 44 and upper plug hole 47, e.g. the camshafts 12, 13 sandwich the plug holes 44, 47. The air intake camshaft 12 and exhaust camshaft 13 are sandwiched between the cylinder head 3 and the cam holder 45, and are fixed in this position by cam holder tightening bolts 48. The cam holder tightening bolts 48 are provided parallel to the axis C, at right angles with respect to the cylinder side mating surface 41 and not at right angles to the cam holder side mating surface 46.

Figure 3:
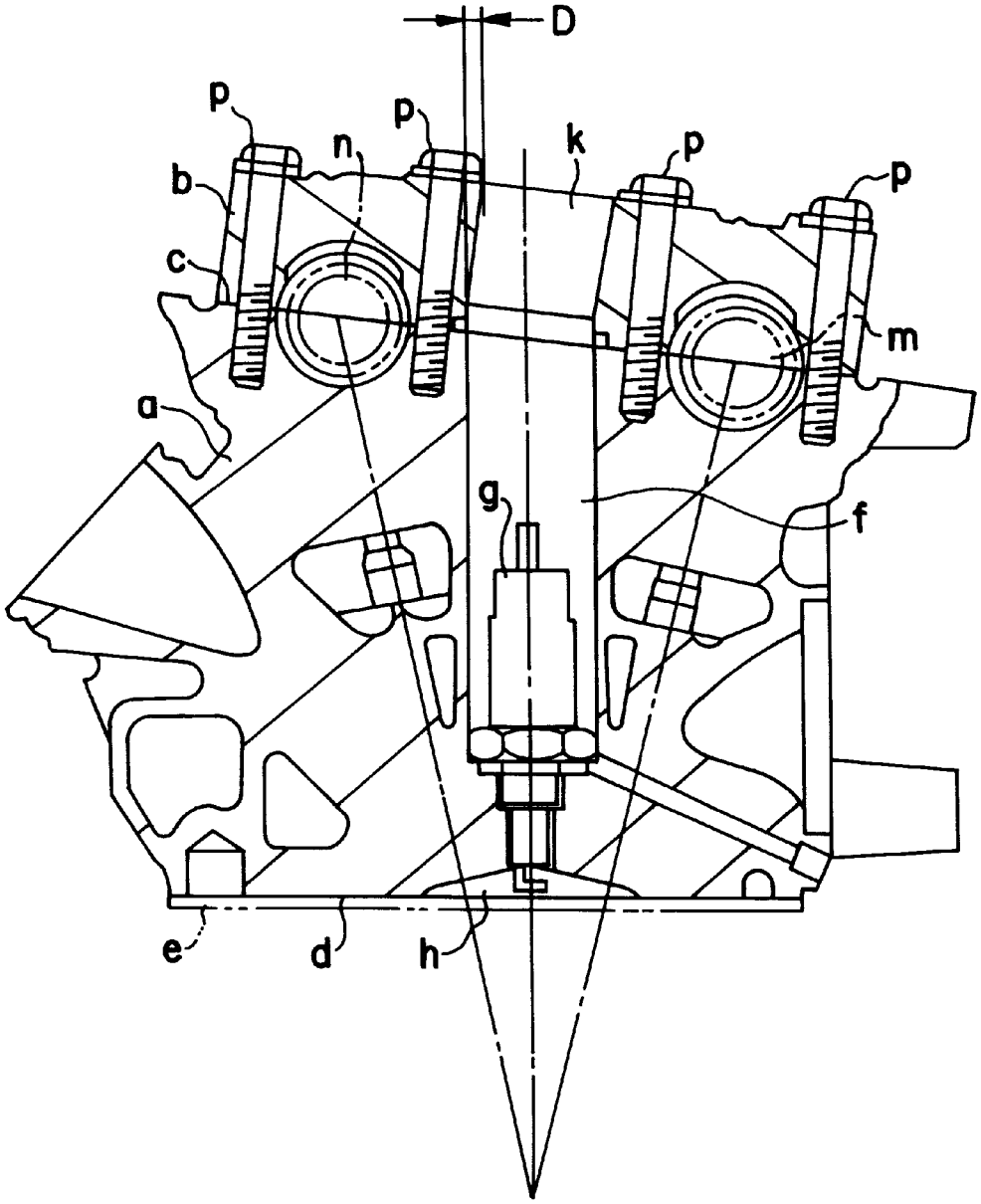
FIG. 3 (BACKGROUND ART)
FIG. 3 is a cross sectional view of a cylinder head and a cam holder, in accordance with the background art.

Several of the benefits of the present invention will now be described. The cam holder tightening bolts 48 are arranged at right angles with respect to the cylinder side mating surface 41. As shown in the FIG. 2, this arrangement makes it possible to make the projection in the inclination direction of the cam holder side mating surface 46 occurring at the external shape of the cam holder 45 small, thereby making it possible to form a compact cylinder head 3. In other words, an exterior surface of the cam holder 45 need not overhang the cylinder head 3, as it did to the extent of the dimension D, as illustrated in the background art in FIG. 3.

Also, the cam holder tightening bolts 48 are arranged parallel to the axis C of the ignition plug 43. By this arrangement, even if the cam holder mating surface 46 is inclined with respect to the cylinder side mating surface 41, the head portion of the cam holder tightening bolt 48 adjacent to the upper plug hole 47 does not protrude to the perimeter of the upper plug hole 47 or lower plug hole 44. This makes it unnecessary to enlarge the gap between the air intake camshaft 12 and the exhaust camshaft 13, e.g. the pinch angle of the camshafts 12, 13. Therefore, it is possible to make the cylinder head 3 small. Moreover, the cam holder 45 does not project over the upper or lower plug holes 47, 44. This makes servicing activities, such as installing and removing the ignition plug 43 easier.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A cylinder head for an internal combustion engine comprising:

a cylinder head body;

a cam holder mating surface formed on one side of said cylinder head body;

a cylinder mating surface formed on another side of said cylinder head body; and at least one threaded bolt hole formed in said cam holder mating surface and extending into said cylinder head body perpendicular to said cylinder mating surface, wherein said cam holder mating surface is inclined with respect to said cylinder mating surface.

2. The cylinder head according to claim 1, wherein said cam holder mating surface includes a first recess for accepting an air intake camshaft and a second recess for accepting an exhaust camshaft.

3. The cylinder head according to claim 2, further comprising:

an ignition plug hole formed in said cylinder head body, between said first recess and said second recess.

4. The cylinder head according to claim 3, wherein said ignition plug hole has an axis of extension which is perpendicular to said cylinder mating surface.

5. The cylinder head according to claim 3, wherein said ignition plug hole has an axis of extension which is non-perpendicular to said cam holder mating surface.

6. The cylinder head according to claim 5, wherein said axis of extension is perpendicular to said cylinder mating surface.

7. The cylinder head according to claim 1, wherein said at least one threaded bolt hole includes four threaded bolt holes each extending into said cylinder head body at a right angle relative to said cylinder mating surface.

8. A cylinder head for an internal combustion engine comprising:

a cylinder head body;

a cam holder mating surface formed on one side of said cylinder head body;

a cylinder mating surface formed on another side of said cylinder head body;

an ignition plug hole formed in said cylinder head body and having an axis of extension; and at least one threaded bolt hole formed in said cam holder mating surface and extending into said cylinder head body parallel to said axis of extension.

9. The cylinder head according to claim 8, wherein said axis of extension is perpendicular to said cylinder mating surface.

10. The cylinder head according to claim 8, wherein said cam holder mating surface includes a first recess for accepting an air intake camshaft and a second recess for accepting an exhaust camshaft.

11. An internal combustion engine comprising:

a cylinder head body;

a cam holder body abutting said cylinder head body at a cam holder mating surface formed on one side of said cylinder head body;

a cylinder mating surface formed on another side of said cylinder head body;

a first threaded bolt hole formed in said cylinder head body;

a second bolt hole formed in said cam holder and aligned with said first threaded bolt hole, wherein said first threaded bolt hole and said second bolt hole extend in a common direction at a right angle relative to said cylinder mating surface, wherein said common direction is non-perpendicular relative to said cam holder mating surface; and a bolt engaged within said first threaded bolt hole and said second bolt hole to attach said cam holder to said cylinder head body.

12. The internal combustion engine according to claim 11, further comprising:

a first ignition plug hole formed in said cylinder head body having a first axis of extension; and a second ignition plug hole formed in said cam holder having a second axis of extension, wherein said second axis of extension is aligned with said first axis of extension.

13. The internal combustion engine according to claim 12, wherein said first axis of extension is perpendicular with respect to said cylinder mating surface.

14. The internal combustion engine according to claim 13, wherein said first axis of extension is non-perpendicular with respect to said cam holder mating surface.

15. The internal combustion engine according to claim 11, further comprising:

an air intake cam shaft disposed between said cylinder head body and said camholder; and an exhaust camshaft disposed between said cylinder head body and said cam holder.

16. The internal combustion engine according to claim 15, wherein said air intake camshaft is parallel to said exhaust camshaft and said first axis of extension passes between said air intake camshaft and said exhaust camshaft.

* * * * *